US005812920A

United States Patent [19]

Mizude et al.

[11] Patent Number: 5,812,920

[45] Date of Patent: Sep. 22, 1998

[54] IMAGE FORMING APPARATUS

[75] Inventors: Kazuhiro Mizude, Yamatokoriyama; Toshihide Ohgoshi, Nara, both of Japan

[73] Assignee: Sharp Kabushiki Kaisha, Osaka, Japan

[21] Appl. No.: 947,316

[22] Filed: Oct. 8, 1997

[30] Foreign Application Priority Data

Nov. 13, 1996 [JP] Japan ..... 8-301514

[51] Int. Cl.[6] ..... G03G 15/16; G03G 15/00

[52] U.S. Cl. ..... 399/316; 399/388; 399/397; 399/400

[58] Field of Search ..... 399/297, 310, 399/311, 316, 388, 397, 400; 250/324–326; 361/225

[56] References Cited

U.S. PATENT DOCUMENTS

| | | | |
|---|---|---|---|
| 4,055,380 | 10/1977 | Borostyan | 399/316 X |
| 4,491,407 | 1/1985 | Mitsuyama et al. | 399/316 |
| 5,717,980 | 2/1998 | Oka et al. | 399/316 X |

FOREIGN PATENT DOCUMENTS 59-34570 2/1984 Japan .

63-210978 9/1988 Japan .

*Primary Examiner*—William J. Royer

*Attorney, Agent, or Firm*—David G. Conlin; George W. Neuner

[57] ABSTRACT

In a conveyance path made up of guide plates which guide a copy sheet to a transfer region between a photoreceptor and an opposing transfer device and a second guide plate for conveying the copy sheet to a fixing rollers, the guide plates and the fixing rollers including a pre-fixing guide, which all will be in contact with copy sheets, are grounded via a common resistor having a high resistance. An adjuster resistor is interposed in series between the common resistor and the guide plates positioned before transfer which are closer from the transfer region compared to the fixing rollers. When a copy sheet resides across the transfer region with both sides in contact with the guide plates and fixing rollers or with one side in contact, the total current that flows during a transfer operation is practically determined by the common resistor which has a high resistance. Accordingly, the flowing current can be limited within a certain range, thus it is possible to stabilize the transfer potential and hence to achieve a stabilized transfer operation.

4 Claims, 3 Drawing Sheets

IMAGE FORMING APPARATUS

BACKGROUND OF THE INVENTION (1) Field of the Invention

The present invention relates to an image forming apparatus which prevents occurrence of image transfer failures when an image formed on a recording medium is transferred to a copy sheet, and especially eliminates transfer failures due to change of surrounding conditions.

(2) Description of the Prior Art

In an image forming apparatus, for example, using an electrophotographic process, a toner image is formed on the photoreceptor as a recording medium, and this toner image is transferred to a copy sheet such as plain paper etc. Then in order to fix the toner image on the copy sheet thereto as a permanent image, the copy sheet is made to pass through, for example, a heat fixing unit so that the toner is thermally fused and fixed to the copy sheet, and then the thus processed sheet is discharged out of the machine body.

In accordance with such an image forming apparatus, in order to form a desired image on a copy sheet, the copy sheet needs to be conveyed to the image forming portion, especially the transfer station. For the copy sheet, one which will not change in its resistance due to change of surrounding conditions is ideal in order to stabilize the transfer state. In general, however, copy sheets vary greatly and change in their resistance due to change of surrounding conditions, such as humidity and temperature, this causing great changes in the transfer state. For example, as the resistance lowers, the charge potential of the copy sheet at the transfer station does not rise, degrading the transfer efficiency and hence often causing transfer void etc.

Provided at the transfer station which typically faces the photoreceptor is a transfer device to maintain the rear side of the copy sheet at a prescribed potential. A guiding means for feeding a copy sheet is provided at the transfer region between this transfer device and the photoreceptor. After transfer, the copy sheet is separated from the photoreceptor and is fed into the fixing unit by a guiding means (inclusive of a conveying means) etc. During this, if the copy sheet is low in its resistance, a great deal of charge flows out through contacting components such as the guiding means etc. which are in contact with the copy sheet. This flow of current causes the loss of potential relating to the transfer process, thus causing transfer void or reduction in transfer efficiency.

In order to limit the current which flows out without contributing to the transfer process, it may be considered that contacting components that are in contact with the copy sheet are made of electrical insulating materials.

Insulating materials, however, become electrified due to friction with the copy sheet, and this potential works to degrade the transfer efficiency. Therefore, in a typical configuration, contacting components for guiding copy sheets to the transfer region as well as contacting components which contact copy sheets after transfer are grounded in order to let the accumulated charge dissipate. In either way, current which will not contribute to the transfer process flows out through the copy sheet by way of contacting components during transfer, and this current will greatly change as the resistance of the copy sheet varies.

To prevent this, the contacting components which are in contact with the copy sheet lying across the transfer region are adapted to be grounded via resistance elements having appropriate resistance. This configuration can limit the flow of current, to thereby avoid the loss of the potential during the transfer process and hence is effective to some degree in dealing with the change in resistance of copy sheets due to change of surrounding conditions such as humidity and temperature.

For example, Japanese Patent Application Laid-Open Sho 59 No. 34,570 discloses a configuration as shown in FIG. 1 in which conductive guides 42 for guiding a copy sheet P into the transfer region between a photoreceptor 40 and a transfer charger 41 disposed facing photoreceptor 40 are grounded via a resistance element 44 while fixing rollers 43 which convey copy sheet P after transfer whilst also fixing it are grounded via a resistance element 45. Thus, the amounts of the currents flowing through guides 42 and fixing rollers 43 are limited by resistance elements 44 and 45 respectively, so that the toner image formed on photoreceptor 40 can be efficiently transferred to copy sheet P whilst the potential of the transfer region is being kept above a prescribed level.

In Japanese Patent Application Laid-Open Sho 63 No. 210,978, another resistance element 47 is provided in the configuration shown in FIG. 1 between a guide member 46 for guiding copy sheet P after transfer to fixing rollers 43 and it is grounded so as to attain a more stabilized transfer efficiency.

In either machine, the contacting portions such as guide members for feeding copy sheet P to the transfer region, guide members and conveying means and the like for conveying the copy sheet after transfer are grounded via respective resistance elements of which resistance is set appropriately.

For example, the resistance values of resistance elements 45 and 44 are set up in association with the resistance values of copy sheet P corresponding to the distance A from wire 48 (the center of the transfer region) which resides at the center of transfer device 41 for corona discharge to fixing rollers 43 and the distance B corresponding to wire 48 to the end of guides 42. Here, designated at 49 is a high-voltage generating circuit for supplying high voltage to wire 48 for corona discharge.

In the apparatuses stated above, it is assumed that copy sheet P is in contact with both sides of contacting components such as guide members, conveying means (fixing rollers) etc., lying across the transfer region. Therefore, the total resistance value varies between the case where the copy sheet is in contact with only one side and the case where the sheet is in contact with both sides, and hence the current that flows out varies greatly.

For example, at first when copy sheet P is conveyed into the transfer region, current flows through guide members 42. This current is determined by a combined resistance of the resistance of copy sheet P and resistance element 44. Then, when the front end of copy sheet P comes into contact with guide member 46 and fixing rollers 43, the sheet is in contact with both sides, and hence current flows out at a level which is determined by the parallel combination of the above combined resistance value and the combined resistance value of the resistance of copy sheet P and resistance element 45 or 47. Thus, the resistance varies greatly between the state where copy sheet P is in contact with both guide members 42 and 46 lying across the transfer station and the state where it is in contact with only one of them. If, for example, the resistance values of resistance elements 45 and 47 are equal to each other and the resistance of the copy sheet is low enough in comparison, the resistance value when the copy sheet is in contact with both sides becomes half as much as the resistance value when it is in contact with one of them, causing a large variation in the potential contributing to the transfer process.

As a result, the transfer conditions greatly change due to the variation of the transfer potential within one copy sheet P, this results in an unstably transferred image.

In conclusion, when the resistance value of copy sheet P varies depending upon the change of the surrounding conditions such as changes in temperature and humidity, the conventional configuration is effective in maintaining the potential contributing to the transfer at the transfer station above a prescribed level, but it becomes impossible to maintain the potential within a certain range during the passage of a single copy sheet P from its front to rear ends, causing variations in transfer conditions and making it impossible to maintain stabilized transfer conditions.

SUMMARY OF THE INVENTION

In view of the above problems, it is therefore an object of the present invention to provide an image forming apparatus which constantly enables stabilized transfer operations under uniform transfer conditions from the start of a copy sheet until the sheet passes through the transfer region.

In order to achieve the above object, the present invention is configurated as follows:

In accordance with the first aspect of the invention, an image forming apparatus comprises:

a photoreceptor for supporting a toner image thereon;

a transfer device disposed facing the photoreceptor and creating a transfer region therebetween in order to allow the toner image to transfer to a copy sheet;

a pre-transfer contacting component which is provided to guide the copy sheet into the transfer region and will be in contact with the copy sheet; and a post-transfer contacting component which is provided after the transfer region and will be in contact with the copy sheet after transfer, and is characterized in that the pre-transfer contacting component and post-transfer contacting component are grounded via a common resistance element and for one of the contacting components which resides closer to the transfer region, an adjuster resistance element having a resistance corresponding to the resistance of the copy sheet extending to the other contacting components which reside farther from the transfer region is interposed in series between the contacting component residing closer and the common resistance element.

In accordance with the second aspect of the invention, the image forming apparatus having the above first feature and is characterized in that the common resistance element is set to have a resistance much greater than the resistance of copy sheets.

In accordance with the third aspect of the invention, the image forming apparatus having the above first feature and is characterized in that the resistance of the adjuster resistance element is set so that the resistance value of the copy sheet corresponding to the distance from the transfer region to the contacting component which resides farther from the transfer region is approximately equal to the combined resistance of the resistance of the copy sheet corresponding to the distance from the transfer region to the other contacting component and the resistance of the adjuster resistance element.

In accordance with the fourth aspect of the invention, the image forming apparatus having the above second feature and is characterized in that the resistance of the adjuster resistance element is set so that the resistance value of the copy sheet corresponding to the distance from the transfer region to the contacting component which resides farther from the transfer region is approximately equal to the combined resistance of the resistance of the copy sheet corresponding to the distance from the transfer region to the other contacting component and the resistance of the adjuster resistance element.

In accordance with the above configurations, when the image, i.e. toner image formed on the photoreceptor is transferred to the copy sheet by the function of the transfer device, transfer current flows via the contacting components positioned before and after transfer. This current is largely determined by the resistance of the common resistor; that is, the current varies little regardless of whether the copy sheet resides across the transfer region with both sides in contact with the connecting components positioned before and after transfer or with only one side in contact. As a result, it is possible to maintain a potential which can effect the transfer operation within a specified substantially uniform range, thus making it possible to create a stabilized transfer state without degrading the transfer efficiency.

Further, in the above configurations, the common resistance element is set to have a resistance much greater than the resistance of copy sheets. Therefore, in this case, if the physical properties of copy sheets vary in accordance with change in humidity and temperature, the variation of the resistance of copy sheets will have very little effect because the resistance of the common resistance element is set high. Therefore, unnecessary current which will flow via the contacting components can be inhibited from greatly changing, regardless of variations of the resistance of copy sheets and hence regulating the current within a specified range.

Moreover, the resistance of the adjuster resistance element is set so that the resistance value of the copy sheet corresponding to the distance from the transfer region to the contacting component which resides farther from the transfer region is approximately equal to the combined resistance of the resistance of the copy sheet corresponding to the distance from the transfer region to the other contacting component and the resistance of the adjuster resistance element. As a result, when the copy sheet is in contact with only one side, the same current flows in either case, constantly maintaining the copy sheet under the same transfer conditions. Further, when the copy sheet is in contact with both sides, almost the same current flows due to the function of the common resistance, thus making it possible to achieve a further stabilized transfer operation.

DESCRIPTION OF THE PREFERRED EMBODIMENTS

Figure 2:
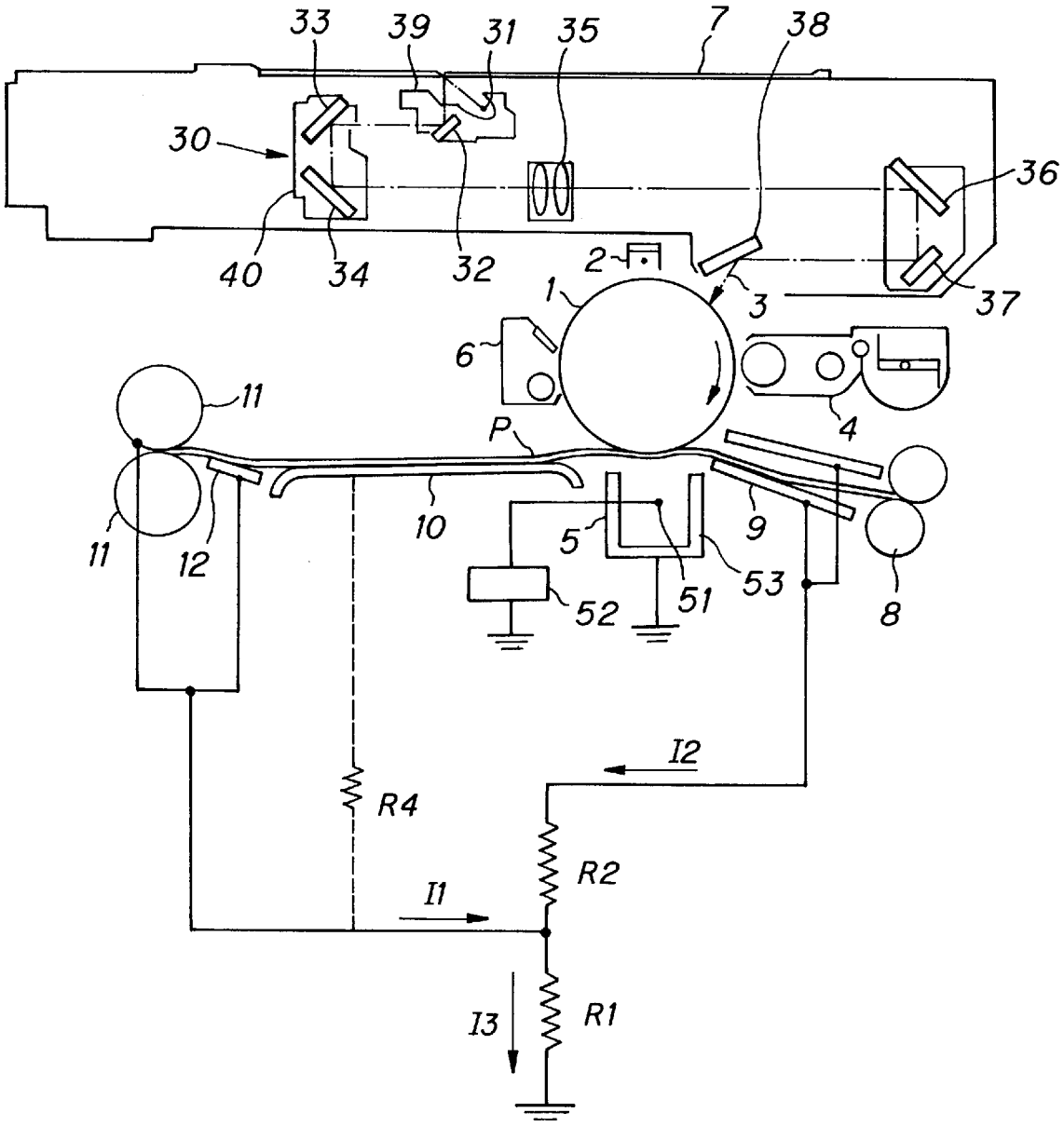
FIG. 2 is a sectional view of an image forming apparatus of the invention specially showing the structure of a copier.

FIG. 2 is a sectional view showing an example of an image forming apparatus of the invention.

One specific example of an image forming apparatus will be described with reference to FIG. 2. First, a cylindrical drum shaped photoreceptor 1 which is rotated in the direction of the arrow as the image forming operation starts is disposed in the center of the image forming apparatus. The following components are provided around, and facing, photoreceptor 1 in the rotational direction thereof: a charger 2 for uniformly charging the photoreceptor surface, an exposure portion 3 for illuminating the photoreceptor surface with an image of light, a developing unit 4 for developing the static latent image formed on the photoreceptor, a transfer device 5 for performing transfer of the image, i.e., toner image, formed on the photoreceptor surface, and a cleaning unit 6 for cleaning off leftover toner on the photoreceptor surface after transfer.

Above exposure portion 3 is an optical system 30 which performs image focusing of an original image placed on an original table 7 on the top part of the apparatus. Optical system 30 comprises an exposure lamp 31 illuminating original table 7, a reflection mirror 32 appropriately reflecting the reflected image of light from the original, a pair of mirrors 33 and 34 reflecting the reflected image of light from reflection mirror 32 toward an image focusing lens 35, and fixed reflection mirrors 36, 37 and 38 for conducting the reflected image of light from image focusing lens 35 onto the surface of photoreceptor 1. The aforementioned exposure lamp 31 and reflection mirror 32 are supported by a common first support 39 and are made to travel in parallel to original table 7 so that the image of the original placed on original table 7 is optically scanned. A pair of reflection mirrors 33 and 34 are supported by a common second support 40 and are made to travel in parallel and in the same direction but at half the speed of first support 39. Accordingly, the original image is optically scanned in harmony with the rotational speed of photoreceptor 1 so that the original image is exposed slit-wise, thus performing image focusing of the entire image of the original onto photoreceptor 1 via image focusing lens 35.

First, photoreceptor 1 is uniformly charged by charger 2 with charge of a specified polarity and is exposed to light at exposure portion 3 so that a static latent image is formed in accordance with the image of the original. This static latent image is visualized in the next step by developing unit 4. Specifically, developing unit 4 has a developing roller inside the developing vessel and causes the developing roller to supply the developer to the developing position facing photoreceptor 1 so that toner in the developer adheres to the latent image formed on the surface of photoreceptor 1 thus performing development.

The toner image, which is the development of the static latent image on photoreceptor 1 by developing unit 4, is conveyed by the rotation of photoreceptor 1 to the transfer station (region) where transfer device 5 faces photoreceptor 1. Here, in order to transfer the toner image formed on photoreceptor 1 onto the copy sheet, a conveyer roller 8 for feeding copy sheets to the transfer station is positioned before the transfer station. Conveyer roller 8 is a resist roller which, in order to make the front end of copy sheet P correspond to the front end of the toner image formed on photoreceptor 1, stops transfer paper P temporarily and then restarts the conveyance so that it is synchronized with the rotational position of photoreceptor 1.

Arranged above and below, between the transfer region (transfer station) created between photoreceptor 1 and transfer device 5, and conveyer roller 8, are a pair of guide members, for example, conductive guide plates 9 for guiding the feeding of copy sheet P to the transfer region. Copy sheet P guided by guide plates 9 is charged at the transfer station with charge of the opposite polarity to that of toner by the function of transfer device 5. The thus generated charge potential causes the toner image formed on photoreceptor 1 to electrostatically transfer to the copy sheet.

When transfer is completed, copy sheet P is separated from photoreceptor 1 and is conveyed along a second guide plate 10 disposed corresponding to the separating position and guided to a pair of fixing rollers 11. Fixing rollers 11 are to fuse and fix toner to copy sheet P in order to cause the toner image supported on copy sheet P to become a permanent image, and include a heat roller which is heated and arranged on the side facing the toner image and a pressure roller for pressing copy sheets against the heat roller surface. Provided before fixing rollers 11 is a pre-fixing guide 12 for guiding copy sheet P being conveyed on second guide plate 10 to fixing rollers 11.

When the conveyance distance of copy sheets between conveyer roller 8 and fixing rollers 11 is longer than the minimum size of copy sheets P, the aforementioned second guide plate 10 should be a conveying means made up of a conveyer belt etc., for conveying copy sheets P. In this case, copy sheets P are conveyed whilst being sucked onto the belt by air suction or other means. When the conveyance distance of copy sheets between conveyer roller 8 and fixing rollers 11 may be shorter than the minimum size of copy sheets, the guide is formed of a simple plate because there is no need for second guide plate 10 to convey copy sheets. (The 1st embodiment)

In the above arrangement, description will be made of an embodiment of the invention which prevents change of the transfer conditions at the transfer region due to change in resistance of copy sheets P, attributed to change of surrounding conditions, and achieves a stabilized transfer process.

Transfer device 5 shown in FIG. 2 is one which uses corona discharge and has a discharging wire 51 which will be supplied with a high voltage as appropriate from a high-voltage generator circuit 52. When high voltage is applied, discharge will start between discharging wire 51 and a shield plate 53 which encloses discharging wire 51 whilst being open on the side facing photoreceptor 1 and discharge current will flow toward photoreceptor 1. As a result, the rear side of copy sheet P being conveyed to the transfer region is charged to a prescribed voltage by the process of corona discharge, so that the toner image electrostatically transfers to the surface of copy sheet P.

Since copy sheet P will change in its resistance depending upon the surrounding atmosphere, especially the humidity and the temperature, and the charge supplied by the aforementioned corona discharge will flow out as a current via guide plates 9 positioned before transfer (the members which are in contact with copy sheet P and positioned before transfer) and fixing rollers 11 etc. positioned after transfer (the members which are in contact with copy sheet P and positioned after transfer), the transfer conditions greatly varies. When copy sheet P has a high resistivity, it allows little current to flow therethrough. The transfer potential contributing to the transfer process of transfer device 5 becomes higher than a prescribed level, resulting in an increased transfer efficiency. On the other hand, when copy sheet P has a low resistivity, it allows a great amount of current to flow out via guide plates 9 and/or fixing rollers 11. Therefore, the potential contributing to the transfer process decreases resulting in a reduced transfer efficiency.

In order to limit the amount of current flowing out via guide plates 9 and/or fixing rollers 11, guide plates 9 and fixing rollers 11 are grounded via a common resistor R1.

Concerning guide plates 9, since their distance to the transfer region is shorter than the distance from the transfer region to fixing rollers 11, the resistance of copy sheet P thereacross is lower. Therefore, an adjuster resistor R2 having a resistance corresponding to the differential resistance derived from the copy sheet is provided in series with the aforementioned common resistor R1. Guide 12 positioned before fixing is also grounded via common resistor R1 in the same manner as fixing rollers 11.

Now, description will be made of the resistance values of common resistor R1 and adjuster resistor R2. The resistance of common resistor R1 is set high enough compared to the resistance of copy sheets P used in this image forming apparatus.

Figure 1:
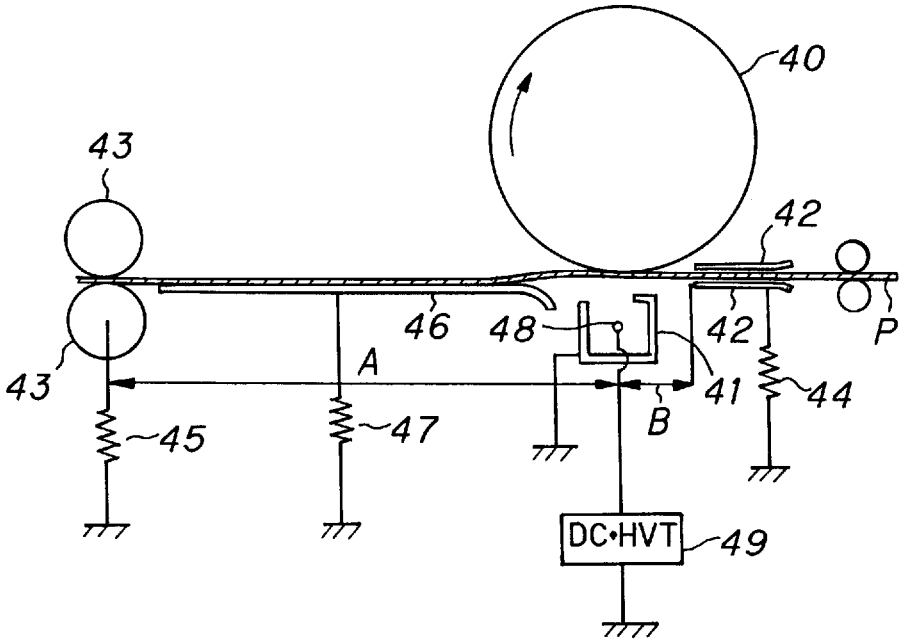
FIG. 1 PRIOR ART
FIG. 1 is a sectional view showing the conveyance path around the transfer region in a conventional image forming apparatus.

On the other hand, the resistance of adjuster resistor R2 is set up in a similar manner as was described when referring to FIG. 1. Specifically, it is assumed that the resistance of copy sheet P corresponding to the distance from the transfer region or wire 51 for corona discharge to fixing rollers 11 is represented as r1 and the resistance of copy sheet P corresponding to the distance from wire 51 for corona discharge (transfer region) to the end of guide plate or the end which is nearest the photoreceptor 1 is r2. Since the length of copy sheet P corresponding to resistance r1 is greater, the difference of r1 and r2 is set as the resistance value of adjuster resistor R2. In other words, the value of adjuster resistor R2 is set in a way that makes the combined resistance of the resistance of adjuster resistor R2 and resistance r2 approximately equal to resistance r1 of copy sheet P.

In the above configuration, in the state where copy sheet P is in contact with both guide plates 9 and fixing rollers 11, currents I1 and I2 flow via guide plates 9 and fixing rollers 11 respectively as shown in the figure when transfer device 5 is activated to cause corona discharge. In this condition, the values of currents I1 and I2 become almost the same because of the provision of adjuster resistor R2 as stated above. Total current I3 is sum of the currents flowing through guide plates 9 and fixing roller 11.

In the state where copy sheet P resides in the transfer region while being in contact with fixing rollers 11 but away from guide plates 9, no current flows through guide plates 9 (I2=0) and only current I1 contributes to total current I3.

In the state where copy sheet P resides in the transfer region whilst being away from fixing rollers 11 but in contact with guide plates 9, no current flows out through fixing rollers 11 (I1=0) and only current I2 contributes to total current I3.

In this configuration, when the resistance of common resistor R1 is set high enough, regardless of whether copy sheet P is in contact with both fixing rollers 11 and guide plates 9 or either of these, current I1 or I2 and the sum of them will be determined largely based on the value of common resistor R1. Illustratively, when considering a state where only one of them is in contact with copy sheet P, the total current I3 (=I1 when I2 is zero, =I2 when I1 is zero) is uniform and hence the transfer conditions can be kept uniform without lowering the transfer efficiency in either states as long as the combined resistance of resistance r2 of the copy sheet and the resistance of adjuster resistor R2 is set equal to resistance r1 of the copy sheet.

In the case where copy sheet P is in contact with both sides, since the combined resistance of resistance r2 of the copy sheet and the resistance of adjuster resistor R2 are approximately equal to that resistance r1 of the copy sheet, the combined resistance becomes half so that the current increases. However, if the resistance of resistor R1 is set much greater, the increase in current is very little.

As a result, in any of the cases, regardless of the copy sheet being in contact with fixing rollers 11 and/or guide plates 9, the current flowing out is practically determined by the resistance of common resistor R1 although slight variation in potential does occur. In this way, this configuration can perform a markedly stabilized transfer operation with slight potential variation.

Further, if the resistance of copy sheet P varies with change in humidity etc., the currents flowing through fixing rollers 11 and guide plates 9 are limited by common resistor R1, whereby a prescribed potential required for transfer can be maintained thus achieving an efficient, stable transfer operation.

In the image forming apparatus of the invention, in order to limit current to flow through the components which are in contact with the copy sheet lying across the transfer region and are grounded, e.g., guide plates 9, conveying means such as conveyer roller 8, fixing rollers 11 etc., common resistor R1 is interposed between each element and the ground. This common resistor R1 is set to have a very high resistance while, for guide plates 9 closer to the transfer region, adjuster resistor R2 which corresponds to the resistance of copy sheet P is added and grounded in series with common resistor R1. In this way, it is possible to achieve a stabilized transfer process as stated above.

(The 2nd embodiment)

The above first embodiment is to deal with the configuration in which guide plates 9 and fixing rollers (including pre-fixing guide 12) are disposed on both sides of the transfer region and both grounded via common resistor R1. There are cases where other components than those mentioned above are in contact with copy sheet P and allow a great deal of transfer current to flow therethrough. The second embodiment will deal with such a case.

Figure 3:
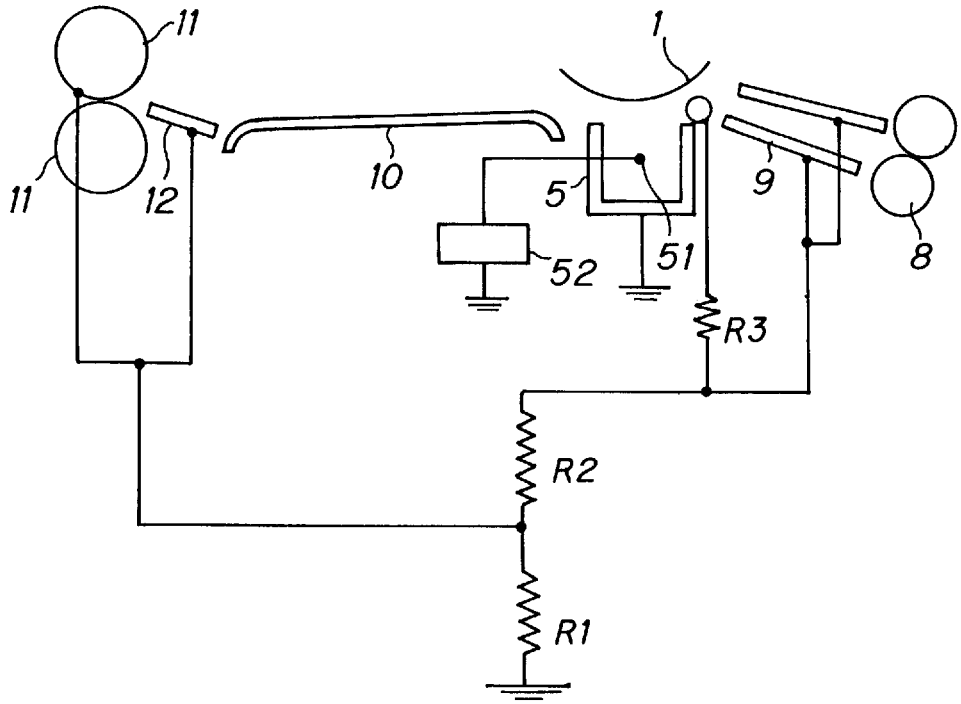
FIG. 3 is a section view explaining the second embodiment of the invention, especially showing the conveying system or guiding copy sheets to the transfer region and guiding copy sheets after transfer.

FIG. 3 shows an example of this case. The difference in this configuration from that shown in FIG. 2 is that a pre-transfer roller 13 is provided in proximity with the surface of photoreceptor 1 in addition to guide plates 9, in order to achieve further smooth feeding of copy sheet P to the transfer region. Since this pre-transfer roller 13 is closer to the transfer region than guide plates 9, an adjuster resistor R3 is additionally connected in series with the series circuit of resistors R1 and R2.

The resistance of adjuster resistor R3 is set so as to conform with resistance r1 of the copy sheet between fixing rollers 11 and the transfer region. Specifically, the resistance of adjuster resistor R3 is set up equal to a measured difference, i.e., resistance r1 of the copy sheet corresponding to the distance from fixing rollers 11 to the transfer region, minus the combined resistance of a resistance r3 of the copy sheet corresponding to the distance from the transfer region to pre-transfer roller 13 and adjuster resistor R2.

Accordingly, similarly to the first embodiment, when copy sheet P is in contact with guide plates 9, pre-transfer roller 13 and/or fixing rollers 11 etc., common resistor R1 serves solely in either case to limit the discharge current from the corona discharge of transfer device 5 flowing through fixing rollers 11, pre-transfer roller 13 and the like. As a result, it is possible to achieve a stable transfer operation without degrading the transfer efficiency.

Further, in the state where copy sheet P is away from fixing rollers 11 and in contact with pre-transfer roller 13 and guide plates 9, adjuster resistor R2 and common resistor R1 serve as a common resistance for both the paths limiting the amount of current flowing out. As a result, it is possible to maintain the transfer potential within a specified range and hence achieve a stable transfer operation even when the rear end of copy sheet P is away from guide plates 9 and is only in contact with pre-transfer roller 13.

In FIG. 2, when second guide plate 10 for guiding the copy sheet after it has passed through the transfer region towards fixing rollers 11 is grounded, and when second guide plate 10 is made up of a conveyer belt etc., for conveying copy sheet P, the guide plate may and should be grounded by connecting it to common resistor R1 via an adjuster resistor R4 in a similar manner as shown by the broken line. In this case, adjuster resistor R4 is set equal to a resistance r4 of the copy sheet corresponding to the distance from the transfer region to second guide plate 10, or set at a value equal to a measured difference, i.e., resistance r1 of the copy sheet to fixing rollers 11 minus resistance r4.

The combined resistance of resistance r4 and that of resistor R4 is set, for example, equal to the combined resistance of resistance r2 of the copy sheet corresponding to the distance from the transfer region to guide plates 9 and resistor R2. In this case, it is possible to achieve as stable a transfer operation as in the case shown in FIG. 3.

Figure 4:
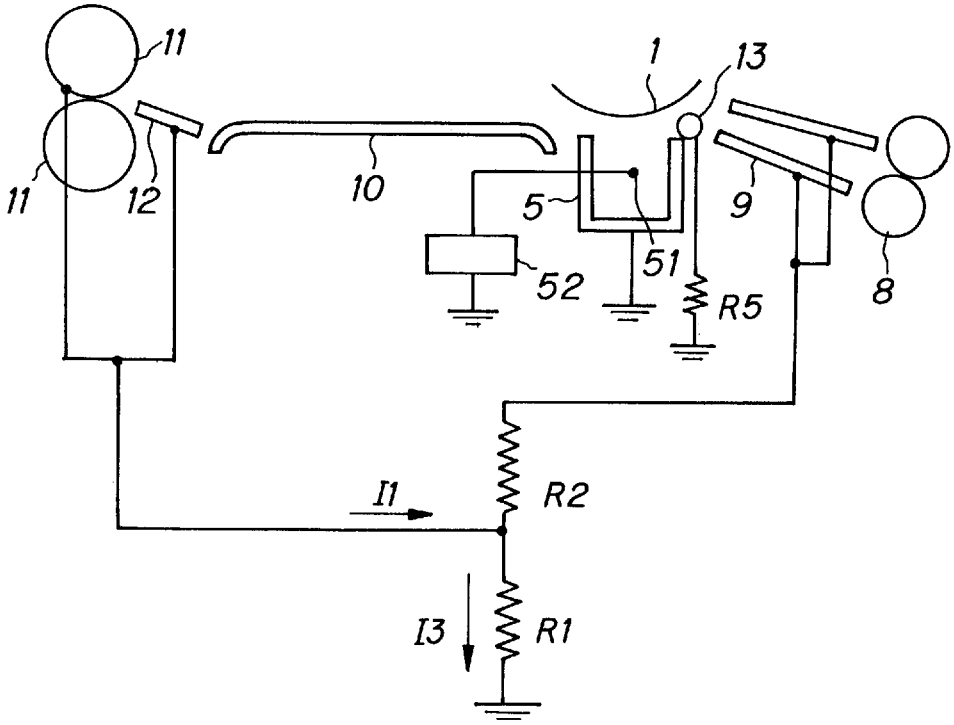
FIG. 4 is a sectional view showing another variation of FIG. 3.

Further, FIG. 4 shows a configuration in which a resistor R5 having a high resistance is connected to ground the closest component to the transfer region, e.g., pre-transfer roller 13. Other components, especially guide plates 9 and fixing rollers 11 are grounded via resistors R1 and/or R2 in the same manner as FIG. 2 in order to prevent the current derived from corona discharge from transfer device 5 from flowing out via guide plates 9 and fixing rollers 11. The resistance of resistor R5 to be connected to pre-transfer roller 13 is of necessity greater than that of common resistor R1. This configuration will be able to inhibit the current derived from corona discharge from transfer device 5 from flowing out via pre-transfer roller 13, the closest element, thus making it possible to achieve an efficient stabilized transfer operation.

Although in description of the first and second embodiments, transfer device 5 was limited to one using corona discharge, the invention can be also applied without modification to configurations in which a transfer roller as a transfer device 5 is pressed against photoreceptor 1 with copy sheet P in between in order to perform transfer. In this case, a voltage of opposite polarity to that of the toner is applied to the transfer roller in order to transfer the toner image to copy sheet P. During this process, transfer current flows out in a similar manner via guide members (inclusive of conveyer rollers etc.) for guiding copy sheet P to the transfer region, and if this current flows excessively, the transfer cannot be performed efficiently. Also transfer current will flow out via guide members for guiding and conveying the copy sheet after transfer.

In order to limit the flow of this current, common resistor R1 and adjuster resistor R2 corresponding to the resistance of the copy sheet are provided as shown in FIGS. 2 through 4, whereby it is possible to limit the flow of the current as well as to keep the amount of the current flow at an almost uniform level, thus constantly achieving stabilized transfer operations with an improved transfer efficiency.

In accordance with the image forming apparatus of the invention, the toner image can be efficiently transferred to a copy sheet in the transfer region and the transfer state during the operation can be stabilized. More specifically, it is possible to constantly perform a stable transfer operation within one copy sheet without changing the transfer conditions from the start until the sheet passes through the transfer region.

Since a common resistor is simply used to ground the transfer related components, the structure can be simplified very much.

Further, higher resistances which are equivalent to the resistance of the copy sheet extending to the farther components are provided for closer components to the transfer region. This configuration assures a further stabilized transfer operation.

What is claimed is:

1. An image forming apparatus comprising:

a photoreceptor for supporting a toner image thereon;

a transfer device disposed facing the photoreceptor and creating a transfer region therebetween in order to allow the toner image to transfer to a copy sheet;

a pre-transfer contacting component which is provided to guide the copy sheet into the transfer region and will be in contact with the copy sheet; and a post-transfer contacting component which is provided after the transfer region and will be in contact with the copy sheet after transfer, characterized in that the pre-transfer contacting component and post-transfer contacting component are grounded via a common resistance element and for one of the contacting components which resides closer to the transfer region, an adjuster resistance element having a resistance corresponding to the resistance of the copy sheet extending to the other contacting components which reside farther from the transfer region is interposed in series between the contacting component residing closer and the common resistance element.

2. The image forming apparatus according to claim 1, wherein the common resistance element is set to have a resistance much greater than the resistance of copy sheets.

3. The image forming apparatus according to claim 1, wherein the resistance of the adjuster resistance element is set so that the resistance value of the copy sheet corresponding to the distance from the transfer region to the contacting component which resides farther from the transfer region is approximately equal to the combined resistance of the resistance of the copy sheet corresponding to the distance from the transfer region to the other contacting component and the resistance of the adjuster resistance element.

4. The image forming apparatus according to claim 2, wherein the resistance of the adjuster resistance element is set so that the resistance value of the copy sheet corresponding to the distance from the transfer region to the contacting component which resides farther from the transfer region is approximately equal to the combined resistance of the resistance of the copy sheet corresponding to the distance from the transfer region to the other contacting component and the resistance of the adjuster resistance element.

* * * * *